US006352740B1

(12) United States Patent
Warnecke

(10) Patent No.: US 6,352,740 B1
(45) Date of Patent: Mar. 5, 2002

(54) METHOD OF COATING AN INNER SURFACE OF A WEAPON BARREL

(75) Inventor: Christian Warnecke, Unterlüss (DE)

(73) Assignee: Rheinmetall W&M GmbH, Unterlüss (DE)

( * ) Notice: Subject to any disclaimer, the term of this patent is extended or adjusted under 35 U.S.C. 154(b) by 0 days.

(21) Appl. No.: 09/590,014

(22) Filed: Jun. 9, 2000

(30) Foreign Application Priority Data

Jun. 9, 1999 (DE) ..... 199 26 246

(51) Int. Cl.[7] ..... B05D 1/00; F41A 21/04

(52) U.S. Cl. ..... 427/11; 427/235; 427/238; 427/239; 427/295; 427/300; 427/367; 427/405; 42/76.02

(58) Field of Search ..... 42/76.02, 76.01; 427/230, 239, 238, 11, 235, 295, 300, 367, 405

(56) References Cited

U.S. PATENT DOCUMENTS 3,261,121 A * 7/1966 Eves ..... 42/76.02
4,701,348 A * 10/1987 Neville ..... 427/57
4,747,225 A * 5/1988 Gstettner et al. ..... 42/76.02
6,183,820 B1 * 2/2001 Neff et al. ..... 427/238

FOREIGN PATENT DOCUMENTS

| | | |
|---|---|---|
| DE | 37 04 774 | 7/1988 |
| DE | 39 07 087 | 9/1990 |

* cited by examiner

*Primary Examiner*—Shrive P. Beck
*Assistant Examiner*—Kirsten A. Crockford
(74) *Attorney, Agent, or Firm*—Venable; Gabor J. Kelemen; Allen Wood

(57) ABSTRACT

A method of coating an inner face of a weapon barrel with a coating material includes the following steps: introducing the coating material as a component in sheet or foil form into the weapon barrel; positioning the component in the weapon barrel such that a first face of the component is oriented toward the inner face of the barrel and a second face of the component is oriented away from the inner face of the barrel; maintaining an annular clearance between the inner face of the barrel and the component; providing the second face of the component with an explosive; and detonating the explosive for hurling the coating material of the component against the inner face of the barrel for effecting a cold welding between the coating material and the inner face of the barrel.

12 Claims, 2 Drawing Sheets

METHOD OF COATING AN INNER SURFACE OF A WEAPON BARREL

CROSS REFERENCE TO RELATED APPLICATION

This application claims the priority of German Application No. 199 26 246.2 filed Jun. 9, 1999.

BACKGROUND OF THE INVENTION

This invention relates to a method of internally coating at least one portion of the inner surface of a weapon barrel with at least one layer for preventing erosion.

In weaponry, efficiency-augmented ammunition causes significant erosions, particularly in steel weapon barrels, due to the high gas temperature and flow velocities generated during firing. Such erosions wear out the barrel even before service-terminating metal fatigue sets in. It has been known to provide the inner surface of weapon barrels with a hard chromium layer to prevent such erosions. Conventionally, the hard chromium is electrolytically deposited on the inner surface of the weapon barrel.

It is a disadvantage of the above-outlined conventional method that, among others, the electrolytically deposited hard chromium layers do not satisfactorily withstand the effect of efficiency-augmented ammunition. Thus, significant erosion phenomena appear at inner barrel areas which consequently lose the chromium coating.

SUMMARY OF THE INVENTION

It is an object of the invention to provide an improved method of coating an inner surface of a weapon barrel with which high melting point layers may be applied to the inner surface of the weapon barrel for preventing erosion and wherein such layer or layers particularly excel in a high degree of adherence.

This object and others to become apparent as the specification progresses, are accomplished by the invention, according to which, briefly stated, the method of coating an inner face of a weapon barrel with a coating material includes the following steps: introducing the coating material as a component in sheet or foil form into the weapon barrel; positioning the component in the weapon barrel such that a first face of the component is oriented toward the inner face of the barrel and a second face of the component is oriented away from the inner face of the barrel; maintaining an annular clearance between the inner face of the barrel and the component; providing the second face of the component with an explosive; and detonating the explosive for hurling the coating material of the component against the inner face of the barrel for effecting a cold welding between the coating material and the inner face of the barrel.

The invention is essentially based on the principle to coat the inner surface of the weapon barrel by explosive plating. In this method, a sheet or foil of the coating material is provided with an explosive substance and is introduced into the weapon barrel in such manner that between the inner surface of the barrel to be coated and the sheet or foil a clearance is maintained. Thus, upon ignition of the explosive the coating material is hurled against the inner face of the barrel and is fused therewith by "cold" welding.

It is a significant advantage of the method according to the invention that high-melting point substances such as niobium, molybdenum, tantalum, hafnium, vanadium, tungsten, zirconium or their alloys may be applied to the inner surface of the weapon barrel in layer thicknesses from a few tenths of a millimeter up to a few millimeters without the effect of a metallurgical exchange between the substances. Consequently, bonds between the weapon barrel and the respective substance are feasible which are not soluble in one another, which form intermetallic phases at high temperatures or which have substantially different melting points.

Advantageously, when performing the method according to the invention, no melting of the barrel material and thus no alloy formation between the barrel material and the coating material takes place. Further, underneath the coating material a heat influx zone is formed. In addition, the explosive plating process offers the possibility to apply a plurality of layers in a simple manner without the individual layers having a mutual metallurgical effect on one another.

The coating material may be applied either to the entire inner surface of the weapon barrel or to selective zones thereof. In either case care has to be taken that the weapon barrel is, before the coating operation, adapted to a suitable wall thickness of the coating material to be applied. Stated differently, the barrel portion to be coated must have a diameter which corresponds to the caliber diameter plus twice the thickness of the layer to be applied.

In accordance with an advantageous feature of the invention, the sheet or foil constituted by the coating material is provided with cutouts which form spacers after the introduction of the sheet or foil into the weapon barrel.

In accordance with a further embodiment of the invention, the sheet or foil part surrounds a cylindrical body. Between the cylindrical body and the sheet or foil part an intermediate space remains into which an explosive (preferably a powder) is introduced.

DESCRIPTION OF THE PREFERRED EMBODIMENT

Figure 1:
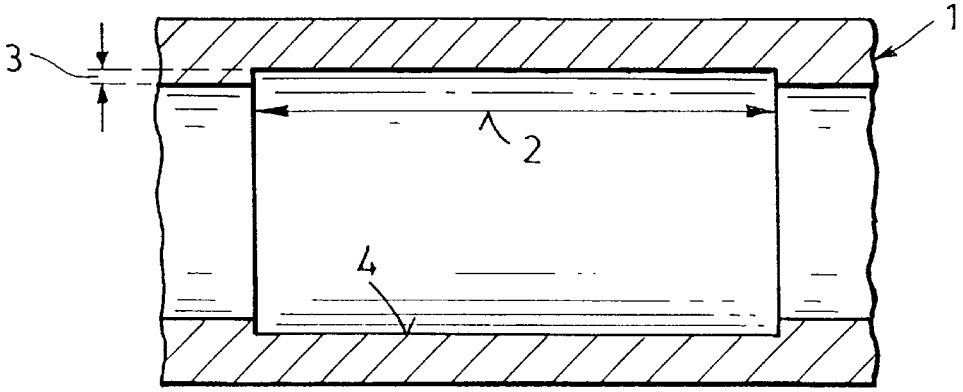
FIG. 1 is a fragmentary axial sectional view of a weapon barrel prior to the introduction of a coating material thereinto.

FIG. 1 shows a weapon barrel 1 whose inner surface is, along the barrel length portion 2, to be provided with a high-melting point metal such as niobium. Along the length portion 2 the weapon barrel has a diametral excess 3 beyond the caliber diameter. Before the coating operation the inner surface 4 is cleaned to remove any dirt or grease.

Figure 2:
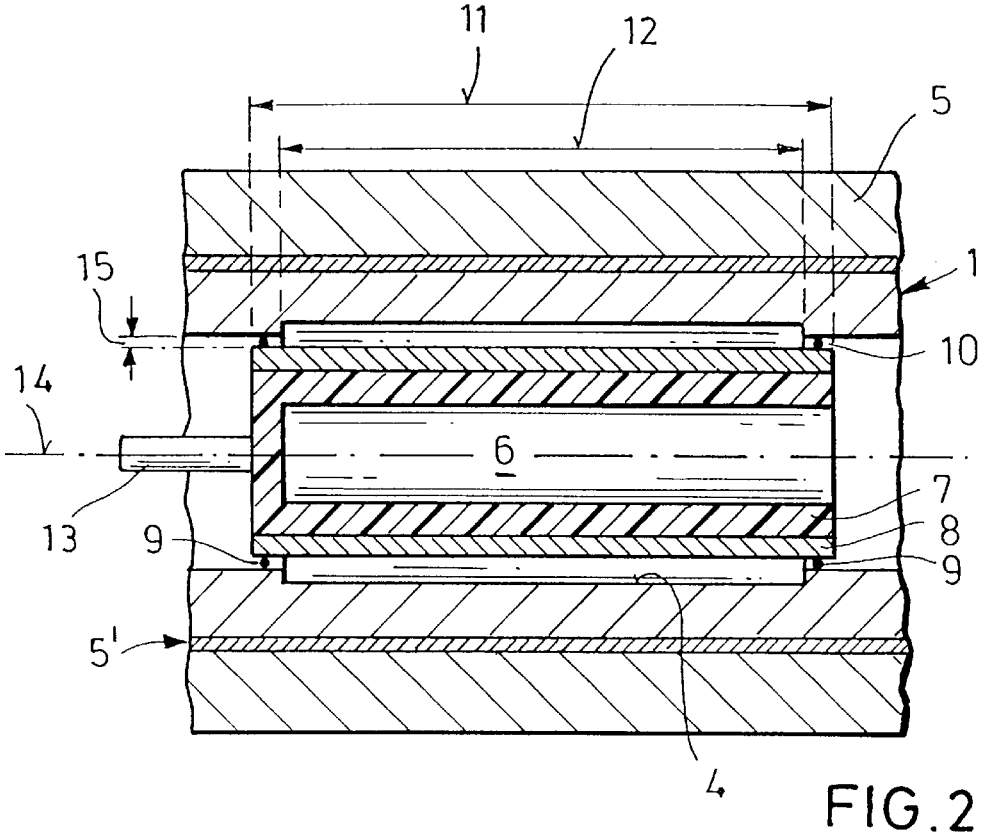
FIG. 2 shows the weapon barrel of FIG. 1 after the introduction of the coating substance thereinto, but before the coating step proper.

For coating the inner surface 4 the weapon barrel 1 is, as shown in FIG. 2, first positioned in a supporting tube 5 for preventing a bloating thereof during the plating operation, particularly in case of thin-walled weapon barrels. Thereafter, any clearance 5' which remains between the supporting tube 5 and the weapon barrel 1 is filled with concrete, epoxy resin or water which is subsequently cooled to form ice.

Subsequently, a cylindrical body 6 is introduced into the weapon barrel 1. The body 6 carries an explosive 7 which, in turn, supports a sleeve 8 formed of the coating substance.

The sleeve 8 is supported on the inner surface 4 of the barrel by spacers 9 (cut out from the sleeve 8) so that between the sleeve 8 and the barrel surface 4 an annular gap 10 remains.

The length 11 of the sleeve 8 is slightly greater than the length 12 of the length portion 2 to be coated to provide for an inlet and outlet of the explosion front.

For performing the plating process the explosive 7 is detonated by a fuze 13 such that over the entire circumference a uniform explosion front is formed which propagates in the direction of the longitudinal barrel axis 14 and progresses over the entire length 11 of the sleeve 8. The coating material forming the sleeve 8 is greatly accelerated at the explosion front and impacts on the inner barrel surface 4 with such a force that the materials bond together as a cold weld. A thorough investigation of the bonding plane between the two materials has shown that this region is of waveform configuration and its area is therefore greater than a linear bonding plane; this circumstance further improves the adherence of the coating material to the upper face of the weapon barrel.

The results of the plating process are essentially determined by the type and quantity of the explosive 7 (velocity of explosion, generated pressure, etc.), the type and wall thickness of the sheet-like component (sleeve) 8 as well as the distance 15 between the coating material and the upper surface 4 of the weapon barrel.

Figure 3:
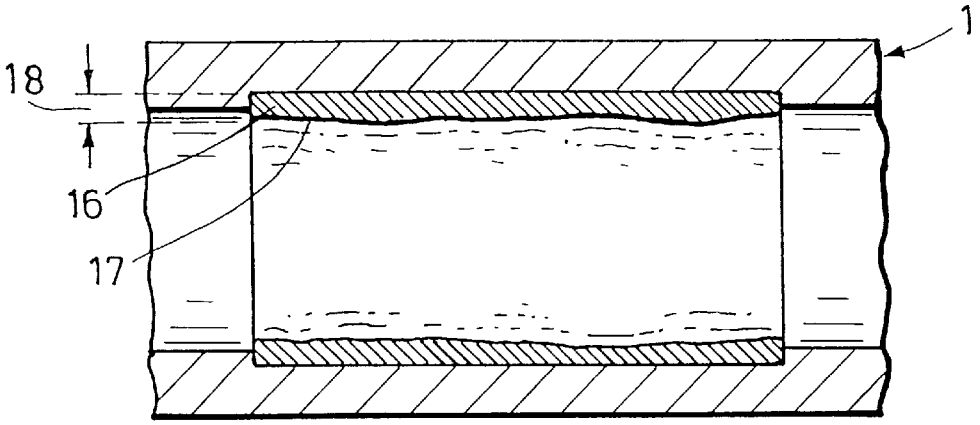
FIG. 3 is a fragmentary axial sectional view of the weapon barrel after performing the coating operation.
Figure 4:
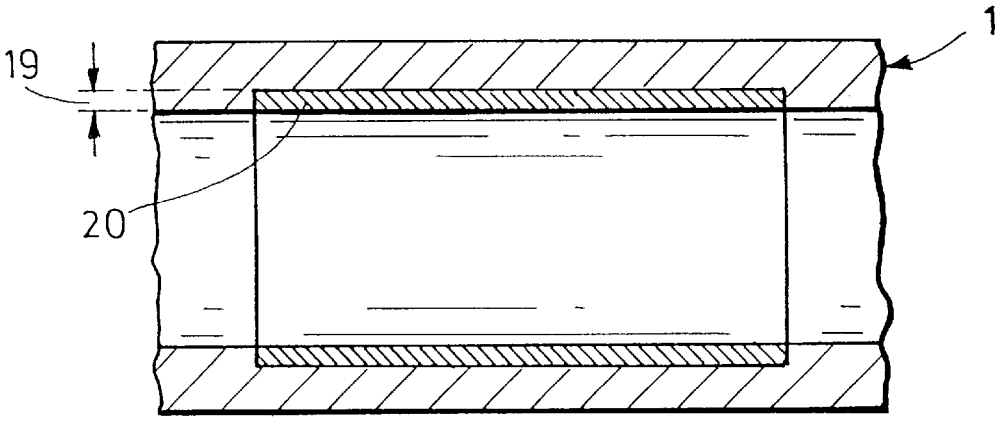
FIG. 4 is a fragmentary axial sectional view of the weapon barrel after performing a machining operation on the structure shown in FIG. 3.

Turning to FIG. 3, after applying the layer 16 to the length portion 2 of the weapon barrel 1 by explosive plating as described above, the inner surface 17 of the coating has a relatively coarse surface which has to be machined to the caliber diameter as shown in FIG. 4. Consequently, the thickness of the deposited layer, as shown in FIG. 3, must be greater than the thickness of the finished layer as shown in FIG. 4.

It is to be understood that the invention is not limited to the described embodiment. Thus, for example, the weapon barrel 1 may be evacuated before the coating operation, in which case the weapon barrel itself constitutes a vacuum chamber. In this manner, one portion of the expanding gas volume may be captured and the braking effect of the air between the coating material and the barrel material may be limited.

To further improve the adherence of the coating material to the inner face of the weapon barrel, it may be advantageous to consecutively provide a plurality of identical or different material layers to the inner surface of the weapon barrel by performing a plurality of successive plating operations, rather than applying only a single layer as shown in FIGS. 3 and 4.

When metal foils are used it has been found to be advantageous to wind one or several turns of the metal foil on a thin carrier tube made, for example, of metal, plastic, cardboard or the like. Such an assembly is utilized as the cylindrical body 6 described in the previous embodiment. It is feasible in such a method to use various foils and combine them when wound around the tube so that after the plating operation the desired layer sequence is obtained on the inner surface of the weapon barrel. It is also feasible to use an alternating sequence of different materials.

It will be understood that the above description of the present invention is susceptible to various modifications, changes and adaptations, and the same are intended to be comprehended within the meaning and range of equivalents of the appended claims.

What is claimed is:

1. A method of coating an inner face of a weapon barrel with a coating material, comprising the following steps:

(a) introducing the coating material as a component having sheet or foil form into the weapon barrel;

(b) positioning the component in the weapon barrel such that a first face of the component is oriented toward the inner face of the barrel and a second face of the component is oriented away from the inner face of the barrel;

(c) using spacers to maintain an equidistant annular clearance between the inner face of the barrel and the component;

(d) providing the second face of the component with an explosive; and (e) detonating the explosive for hurling the coating material of the component against the inner face of the barrel for effecting a cold welding between the coating material and the inner face of the barrel.

2. The method as defined in claim 1, wherein the coating material is selected from the group consisting of niobium, molybdenum, tantalum, hafnium, vanadium, tungsten, zirconium, and alloys thereof.

3. The method as defined in claim 1, further comprising the step of positioning the component on a cylindrical body while maintaining an intermediate space between the component and the cylindrical body; said step (d) comprising the step of placing the explosive in said intermediate space.

4. The method as defined in claim 3, wherein said step (d) comprises the step of placing the explosive in powder form in said intermediate space.

5. The method as defined in claim 1, further comprising the step of repeating steps (a) through (e) for providing a plurality of superposed coatings on said inner face of the weapon barrel.

6. The method as defined in claim 1, further comprising the step of positioning a plurality of components formed of unlike coating material on a cylindrical body while maintaining an intermediate space between the components and the cylindrical body; said step (d) comprising the step of placing the explosive in said intermediate space.

7. The method as defined in claim 1, further comprising the step of performing step (e) in a vacuum.

8. The method as defined in claim 1, further comprising the step of positioning the weapon barrel in a support tube prior to performing step (e) for preventing a bloating of the weapon barrel when step (e) is performed.

9. The method as defined in claim 1, further comprising the following steps, conducted before the explosive is detonated: inserting the barrel into a supporting tube, and introducing a liquid into a clearance gap between the barrel and the supporting tube.

10. The method as defined in claim 9, wherein the liquid is selected from the group consisting of concrete, epoxy resin, and water.

11. The method as defined in claim 10, wherein the liquid is water, and further comprising the step of freezing the water before the explosive is detonated.

12. A method of depositing coating material in a bore of a weapon barrel, the bore having a predetermined diameter, said method comprising the following steps:

(a) forming a cylindrical cavity in the bore, the cavity having a diameter that is greater than the diameter of the bore;

(b) introducing the coating material as a component having sheet or foil form into the weapon barrel;

(c) positioning the component in the weapon barrel such that a first face of the component is oriented toward the cavity and a second face of the component is oriented away from the cavity;

(d) maintaining an annular clearance between the cavity and the component;

(e) providing the second face of the component with an explosive;

(f) detonating the explosive for hurling the coating material of the component into the cavity to weld the coating material to the barrel, the welded coating material having an inner face that is roughened and that has a cross-sectional dimension smaller than the diameter of the bore; and (g) machining the inner face of the welded coating material until it is cylindrical, with the cross-sectional dimension being approximately the same as the diameter of the bore.

* * * * *